US010857507B2

(12) United States Patent
Vellaiah Retnaswamy

(10) Patent No.: US 10,857,507 B2
(45) Date of Patent: Dec. 8, 2020

(54) APPARATUS FOR DISPERSING PARTICLES IN A LIQUID

(71) Applicant: ALFA LAVAL CORPORATE AB, Lund (SE)

(72) Inventor: Ashok Vellaiah Retnaswamy, Humble, TX (US)

(73) Assignee: ALFA LAVAL CORPORATE AB, Lund (SE)

( * ) Notice: Subject to any disclaimer, the term of this patent is extended or adjusted under 35 U.S.C. 154(b) by 17 days.

(21) Appl. No.: 15/713,030

(22) Filed: Sep. 22, 2017

(65) Prior Publication Data

US 2018/0008941 A1 Jan. 11, 2018

Related U.S. Application Data

(63) Continuation-in-part of application No. 15/078,551, filed on Mar. 23, 2016, now Pat. No. 9,950,328.

(51) Int. Cl.
*B01F 5/02* (2006.01)
*B05B 1/02* (2006.01)
(Continued)

(52) U.S. Cl.
CPC ..... *B01F 5/0281* (2013.01); *B01F 5/0256* (2013.01); *B01F 5/0275* (2013.01);
(Continued)

(58) Field of Classification Search
CPC ..... B05B 15/20; B05B 15/65; B05B 15/652; B05B 1/02; B05B 1/26; B05B 1/267;
(Continued)

(56) References Cited

U.S. PATENT DOCUMENTS 1,845,969 A * 2/1932 Hueber ..... B60S 1/10 417/159
2,235,258 A * 3/1941 Jones ..... B05B 1/14 239/544
(Continued)

FOREIGN PATENT DOCUMENTS

CN 201161168 U 12/2008
CN 205146011 U 4/2016
(Continued)

OTHER PUBLICATIONS

Search Report dated Jun. 19, 2018 for Application No. PCT/US2017/052966.
(Continued)

*Primary Examiner* — Joseph A Greenlund
(74) *Attorney, Agent, or Firm* — Patterson + Sheridan, LLP

(57) ABSTRACT

In one example, a liquid mixture nozzle for flowing a liquid mixture therethrough includes a body having a flow inlet and a flow outlet. The flow inlet is configured to couple to a first piece of piping and the flow outlet is configured to couple to a second piece of piping. The liquid mixture nozzle also includes a converging section having a decreasing diameter positioned adjacent the flow inlet, an orifice positioned at a narrow end of the converging section, an intermediate section having a constant diameter positioned adjacent the orifice, a diverging section having an increasing diameter positioned adjacent the intermediate section and the flow outlet.

26 Claims, 4 Drawing Sheets

(51) Int. Cl.

| | |
|---|---|
| ***B01F 5/06*** | (2006.01) |
| ***B01F 5/08*** | (2006.01) |
| ***B01F 15/00*** | (2006.01) |
| ***B05B 12/08*** | (2006.01) |
| ***B05B 15/20*** | (2018.01) |
| ***B05B 7/14*** | (2006.01) |
| ***B05B 1/26*** | (2006.01) |
| ***E21B 21/06*** | (2006.01) |
| ***B01F 13/10*** | (2006.01) |
| ***B05B 7/08*** | (2006.01) |
| ***B05B 15/65*** | (2018.01) |

(52) U.S. Cl.
CPC ..... *B01F 5/064* (2013.01); *B01F 5/08* (2013.01); *B01F 13/1022* (2013.01); *B01F 15/00344* (2013.01); *B01F 15/00357* (2013.01); *B05B 1/02* (2013.01); *B05B 1/26* (2013.01); *B05B 7/0846* (2013.01); *B05B 7/1481* (2013.01); *B05B 12/08* (2013.01); *B05B 15/20* (2018.02); *B05B 15/65* (2018.02); *E21B 21/062* (2013.01)

(58) Field of Classification Search
CPC ..... B05B 7/0846; B05B 7/1481; B05B 12/08; B01F 5/064; B01F 5/08; B01F 5/0413; B01F 13/1016; B01F 15/00344; B01F 15/00357
USPC ..... 239/429, 433, 421
See application file for complete search history.

(56) References Cited

U.S. PATENT DOCUMENTS 2,361,980 A * 11/1944 Tirrell ..... A62D 1/0071 169/15
2,719,704 A * 10/1955 Anderson ..... B01F 5/0403 261/18.1
2,770,501 A * 11/1956 Coanda ..... B01F 5/0256 239/429
2,785,926 A * 3/1957 Lataste ..... B05B 1/14 239/438
2,965,312 A * 12/1960 Hale ..... E04F 21/12 239/416.5
3,272,441 A * 9/1966 Davis Sr. ..... F23D 11/10 239/403
3,833,718 A * 9/1974 Reed et al. ..... B01F 5/064 423/629
3,840,183 A * 10/1974 Kuribayashi ..... B01F 5/0473 239/305
3,849,057 A * 11/1974 Peck ..... B24C 5/00 431/158
4,123,800 A * 10/1978 Mazzei ..... B01F 5/0653 366/163.2
4,308,138 A * 12/1981 Woltman ..... B01F 3/0876 210/220
4,324,365 A * 4/1982 Howarth ..... B05B 7/045 239/424
4,415,123 A * 11/1983 Ikeuchi ..... B05B 7/0846 239/425
4,664,147 A * 5/1987 Maddock ..... B01F 5/0415 137/599.12
4,783,008 A * 11/1988 Ikeuchi ..... B05B 7/064 239/421
4,909,914 A * 3/1990 Chiba ..... B01J 19/26 118/715
5,037,616 A * 8/1991 Williatte ..... B01J 8/1827 422/140
5,073,309 A * 12/1991 Bousquet ..... B01F 3/0876 261/29
5,080,286 A * 1/1992 Morrison ..... B05B 1/323 239/533.13
5,082,633 A * 1/1992 Stuper ..... B29B 7/7694 422/133
5,445,226 A * 8/1995 Scott ..... A62C 31/12 169/15
5,613,773 A * 3/1997 Scott ..... A62C 31/12 169/44
5,664,733 A * 9/1997 Lott ..... B01F 5/02 239/429
5,674,312 A * 10/1997 Mazzei ..... B01D 19/0005 210/512.1
5,676,173 A * 10/1997 Conrad ..... G05D 11/006 137/599.03
5,693,226 A * 12/1997 Kool ..... C02F 3/1294 137/888
5,810,252 A * 9/1998 Pennamen ..... B05B 7/0491 239/8
5,863,128 A * 1/1999 Mazzei ..... B01F 5/0415 137/888
5,890,661 A * 4/1999 Crampton ..... B05B 1/26 239/333
5,920,925 A * 7/1999 Dongo ..... A61H 33/027 239/601
5,927,852 A * 7/1999 Serafin ..... B01F 5/0644 366/144
5,964,418 A * 10/1999 Scarpa ..... B05B 7/1495 239/424
6,076,750 A * 6/2000 Mykkanen ..... B65B 39/00 141/311 A
6,088,934 A * 7/2000 Newton ..... B01J 19/26 34/360
6,113,013 A * 9/2000 Sand ..... B05B 7/0846 239/543
6,158,471 A * 12/2000 Greif ..... B01F 5/0413 137/599.12
6,173,526 B1 * 1/2001 Mazzei ..... A01B 79/02 47/48.5
6,234,664 B1 * 5/2001 Tromley ..... B01F 5/0256 366/136
6,322,008 B1 * 11/2001 Aker ..... B05B 1/26 239/543
6,502,767 B2 * 1/2003 Kay ..... B05B 7/1486 239/433
6,623,154 B1 * 9/2003 Garcia ..... B01F 5/0415 366/163.2
6,722,584 B2 * 4/2004 Kay ..... B05B 7/1486 239/433
6,730,214 B2 * 5/2004 Mazzei ..... B01D 19/0068 210/188
6,814,150 B2 11/2004 Clauss et al.
7,219,849 B1 * 5/2007 Hedger ..... B05B 1/26 239/543
7,287,597 B2 * 10/2007 Shaposhnikov .... E21B 41/0078 166/372
7,357,565 B2 * 4/2008 Gopalan ..... B01F 3/04503 239/533.2
7,401,973 B1 * 7/2008 Lott ..... B01F 3/1228 366/143
7,563,019 B2 * 7/2009 Buchholz ..... B01F 5/0077 137/597
7,618,182 B1 * 11/2009 Lott ..... B01F 3/1228 366/163.1
7,621,463 B2 * 11/2009 Presz, Jr. ..... B05B 1/341 239/101
7,621,466 B2 * 11/2009 Ko ..... B05B 7/1486 239/398
7,651,621 B2 * 1/2010 Kelsey ..... B01D 19/0005 210/739
7,779,864 B2 * 8/2010 Mazzei ..... B01F 5/0256 137/599.03
7,926,502 B1 * 4/2011 Lott ..... B01F 5/043 137/15.04
8,016,215 B1 * 9/2011 Zhadanov ..... B05B 1/185 239/544
8,313,717 B2 * 11/2012 Boe ..... B05B 1/26 423/212

(56) References Cited

U.S. PATENT DOCUMENTS 8,408,479 B2 * 4/2013 Di Loreto ..... C23C 4/12 239/85
8,596,857 B2 * 12/2013 Bastesen ..... B01F 5/0256 366/136
8,702,019 B2 * 4/2014 Chen ..... C12N 15/895 239/311
8,814,532 B2 * 8/2014 Ogata ..... F04F 5/46 417/151
8,845,178 B2 * 9/2014 Hanada ..... B01F 5/0413 366/163.2
9,168,498 B2 10/2015 Muller et al.
9,242,260 B2 * 1/2016 Stevenson ..... B01F 5/043
9,382,922 B2 * 7/2016 Dunning ..... F04F 5/44
9,950,328 B2 * 4/2018 Vellaiah Retnaswamy ..... B01F 5/08
10,151,283 B2 * 12/2018 Graichen ..... F04F 5/20
10,266,436 B2 * 4/2019 Whitmore, Sr. ..... C02F 1/686
2005/0040260 A1 * 2/2005 Zhao ..... B05B 7/1486 239/548
2005/0133615 A1 * 6/2005 Gopalan ..... B01F 3/04503 239/88
2005/0161532 A1 * 7/2005 Steenkiste ..... C23C 24/04 239/433
2006/0109738 A1 * 5/2006 Buchholz ..... B01F 5/0077 366/162.4
2007/0057083 A1 * 3/2007 Bolz ..... B05B 7/0012 239/34
2008/0001007 A1 * 1/2008 Gilpatrick ..... B08B 3/026 239/310
2008/0048048 A1 * 2/2008 Noestheden ..... B05B 1/12 239/101
2008/0094936 A1 * 4/2008 Corti ..... B29B 7/7636 366/162.4
2010/0258654 A1 * 10/2010 Peterson ..... B05B 15/65 239/557
2011/0236227 A1 * 9/2011 Ogata ..... F04F 5/20 417/151
2011/0277379 A1 11/2011 Bortkevitch et al.
2012/0307588 A1 * 12/2012 Hanada ..... B01F 3/0865 366/336
2013/0068852 A1 * 3/2013 Wurz ..... B01F 5/0405 239/8
2013/0294189 A1 * 11/2013 Myrick ..... A61M 1/32 366/162.4
2014/0301157 A1 * 10/2014 Glanville ..... B01F 5/0652 366/337
2015/0366127 A1 * 12/2015 Roberge ..... A01C 15/04 239/8
2018/0008941 A1 * 1/2018 Vellaiah Retnaswamy ..... E21B 21/062
2019/0024491 A1 1/2019 Fielder et al.

FOREIGN PATENT DOCUMENTS

DE 1689819 U 12/1954
DE 3619857 C2 5/1989
DE 19536845 A1 4/1997
DE 20306915 U1 8/2003
GB 543995 A 3/1942
GB 949954 A 2/1964
WO 96/14941 A1 5/1996
WO 2006125191 A2 11/2006
WO 2008023252 A2 2/2008
WO 2008/058548 A1 5/2008
WO 2017162449 A1 9/2017

OTHER PUBLICATIONS

Communication dated Jun. 13, 2017 issued by the European Patent Office in corresponding International Application No. PCT/EP2017/055698 (14 pages).
Final Office Action dated Aug. 24, 2017 for U.S. Appl. No. 15/078,551.
Non-Final Office Action dated Apr. 27, 2017 for U.S. Appl. No. 15/078,551.
International Search Report dated Mar. 3, 2017 for Application No. PCT/EP2017/055698.

* cited by examiner

APPARATUS FOR DISPERSING PARTICLES IN A LIQUID

CROSS-REFERENCE TO RELATED APPLICATIONS

This application is a continuation-in-part of U.S. patent application Ser. No. 15/078,551, filed Mar. 23, 2016, which is herein incorporated by reference.

TECHNICAL FIELD

Aspects of the disclosure relate to apparatuses and methods for dispersing particles in a liquid.

BACKGROUND ART

Within the oil and gas industry, there are certain needs for mixing particles within a liquid, such as drilling mud. The purpose of the mixing is to achieve homogenization and dispersion of particles in the liquid. A number of technologies for obtaining mixing are used, including rotating shear units, conventional stirring techniques, and vibration based techniques. The mixing is performed in one or more stages and is typically effected in one or more shearing zones where liquid undergoes "shear", which happens when liquid travels with a different velocity relative to an adjacent area or liquid volume.

One example of a mixer type is shown in patent document U.S. Pat. No. 3,833,718 which describes a so called jet mixer. This mixer is used for providing high shear mixing of liquid such as in the preparation of slurry solutions for well treating. The mixing principle is based on forming a shear zone at the confluence of opposing streams of a mixture of liquid and particles. The mixer is based on separating the liquid into two streams and then directing the streams towards each other. The streams are directed into the mixing zone from a location substantially at right angles to each other to cause mixing.

The described mixer seems to provide adequate mixing. However, it is estimated that the mixing of conventional mixers may be further improved.

SUMMARY

In one example, a liquid mixture nozzle for flowing a liquid mixture therethrough, comprises a body having a flow inlet and a flow outlet. The flow inlet is configured to couple to a first piece of piping and the flow outlet is configured to couple to a second piece of piping. The liquid mixture nozzle also includes a converging section having a decreasing diameter positioned adjacent the flow inlet, an orifice positioned at a narrow end of the converging section, an intermediate section having a constant diameter positioned adjacent the orifice, a diverging section having an increasing diameter positioned adjacent the intermediate section and the flow outlet.

In another example, a flow system comprises a flow inlet pipe, a flow outlet pipe, and a first liquid mixture nozzle connected to the flow inlet pipe at an upstream end of the liquid mixture nozzle, and connected to the flow outlet pipe at a downstream end of the liquid mixture nozzle. The liquid mixture nozzle comprises a body having a flow inlet and a flow outlet, a converging section having a decreasing diameter positioned adjacent the flow inlet, an orifice positioned at a narrow end of the converging section, an intermediate section having a constant diameter positioned adjacent the converging section, and a diverging section having an increasing diameter positioned adjacent the intermediate section and the flow outlet.

In another example, a method for dispersing particles in drilling mud comprises flowing the drilling mud through a converging flow section to increase the velocity of the drilling mud, flowing the drilling mud through an orifice located downstream of the converging section, and flowing the drilling mud through a diverging section located downstream of the orifice, thereby generating turbulence within the drilling mud to enhance dispersion of particles within the drilling mud.

The apparatuses may include a number of different features as described below, alone or in combination. The apparatus that is used in the method may include the same features. Aspects and advantages of the embodiments described herein will appear from the following detailed description as well as from the drawings. It is contemplated that aspects described in one embodiment may be incorporated into other embodiments without further recitation.

BRIEF DESCRIPTION OF THE DRAWINGS

Embodiments of the disclosure will now be described, by way of example, with reference to the accompanying schematic drawings, in which.

DETAILED DESCRIPTION

Figure 1:
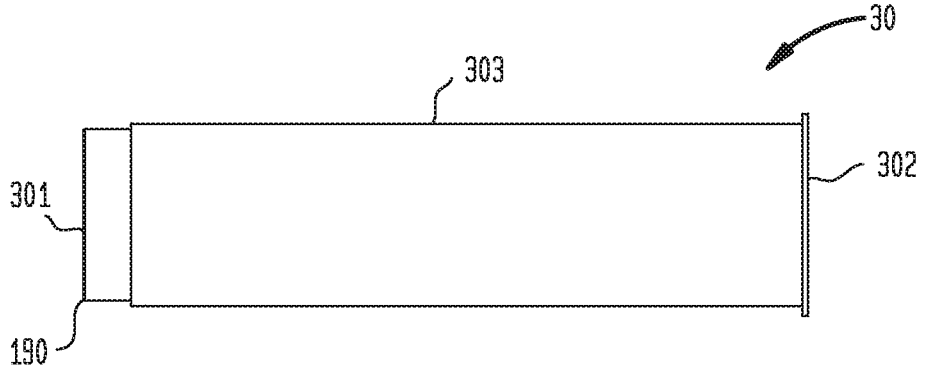
FIG. 1 is a side view of a nozzle according to one aspect of the disclosure.
Figure 2:
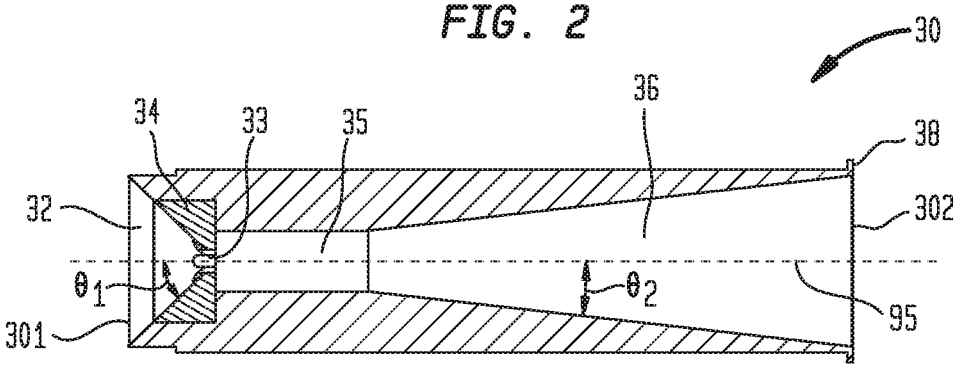
FIG. 2 is a cross-sectional side view of the nozzle of FIG. 1.

FIGS. 1-5 are various schematic views of a nozzle 30, according to aspects of the disclosure. With reference to FIGS. 1-5, the nozzle 30 includes a body defined by an elongated cylindrical surface 303. The nozzle 30 includes an inlet 301 into which a liquid stream flows, and an outlet 302 from which the liquid stream exits the first nozzle 30. An exemplary liquid mixture for flow through the nozzle 30 is drilling mud.

In geotechnical engineering, drilling mud is used to aid the drilling of boreholes into the Earth. The main functions of drilling mud include providing hydrostatic pressure to prevent formation fluids from entering into a well bore, keeping a drill bit cool and clean during drilling, carrying out drill cuttings, and suspending the drill cuttings while drilling is paused and when the drilling assembly is brought in and out of the hole. The drilling mud used for a particular job is selected to avoid formation damage and to limit corrosion. Water-based drilling mud most commonly consists of bentonite clay with additives such as barium sulfate (barite), calcium carbonate (chalk) or hematite.

In addition, various thickeners may be used to influence the viscosity of the drilling mud, e.g. xanthan gum, guar gum, glycol, carboxymethylcellulose, polyanionic cellulose (PAC), or starch. In turn, de-flocculants, such as anionic polyelectrolytes (e.g., acrylates, polyphosphate, lignosulfonates, or tannic acid) may be used to reduced viscosity, particularly when using clay-based muds. Other common additives include lubricants, shale inhibitors, and fluid loss additives (to control loss of drilling fluids into permeable formations).

Returning to the nozzle 30, to facilitate coupling with piping or other components, the first nozzle 30 also includes a circumferential flange 38 adjacent the outlet 302. Adjacent the flow inlet 301, the nozzle 30 has a reduced diameter section 190 for insertion into piping to facilitate coupling therewith. Alternatively, the positions of the flange 38 and the reduced diameter section 190 may be reversed, a flange may be utilized in place of the reduced diameter section 190, or a reduced diameter section may be utilized in place of the flange 38.

The nozzle 30 includes, in a liquid flow direction, a liquid converging section 32 at the inlet 301, an orifice 33, an intermediate flow section 35, and a diverging section 36. The liquid converging section 32 converges towards the orifice 33, e.g., the liquid converging section 32 has a cross-sectional area that decreases in a direction towards the orifice 33. Stated otherwise, the diameter of the converging section 32 decreases in a downstream direction. The converging section 32 may have a linear convergence or a curved convergence, or a combination thereof. The converging section 32 converges downward to an orifice 33, through which liquid travels.

The intermediate flow section 35 is located between the orifice 33 and the liquid diverging section 36. The intermediate flow section 35 has a constant cross-sectional area, e.g., a constant diameter. The intermediate flow section 35 may have a circular, elliptical, star or other suitable cross-sectional shape in a plane orthogonal to a central longitudinal axis of the intermediate flow section 35. The diverging section 36 is positioned adjacent to and downstream of the intermediate flow section 35. The diverging section 36 may have a linear divergence, a curved divergence, a combination thereof or another shape for the divergence. The diverging section 36 may also have a step wise divergence. In this context "diverging section" may be understood as a section with a cross-sectional area that increases in a direction of a flow of the liquid. A linear divergence or a slightly curved divergence may be utilized, since such a divergence gives an advantageous relationship between a liquid velocity and a pressure drop when a liquid passes through the nozzle 30.

In one example, a ratio of the cross sectional areas of the intermediate section 35 to a narrow end of the converging section 32 (e.g., the portion of the converging section 32 adjacent the orifice 33) is within a range of 2:1 to 6:1. Additionally or alternatively, the angle $\theta_1$ between an axial centerline 95 of the nozzle 30 and a sidewall of the converging section 32 (e.g., the half angle) is within a range of about 30 degrees to about 50 degrees. Moreover, the angle $\theta_2$ between the axial centerline 95 and a sidewall of the diverging section 36 (e.g., the half angle) is within a range of about 5 degrees to about 10 degrees. It is contemplated that the ratio between the half angle of the converging section to the half angle of the diverging section is about 3:1 to about 10:1. In one example, the axial centerline of each of the converging section 32, the orifice 33, the intermediate flow section 35, and the diverging section 36 is coaxial with the axial centerline 95. In one example, the length of the intermediate flow section 35 is equal to or greater than the outer diameter of the nozzle 30 or the outer diameter of a pipe coupled to the nozzle 30. For example, when using the nozzle 30 with a 6 inch diameter pipe, the intermediate flow section 35 of the nozzle 30 may be 6 inches or longer.

Figure 3:
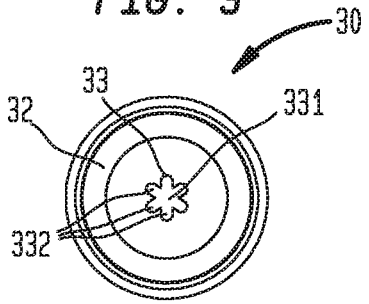
FIG. 3 is a front view of the nozzle of FIG. 1.
Figure 4:
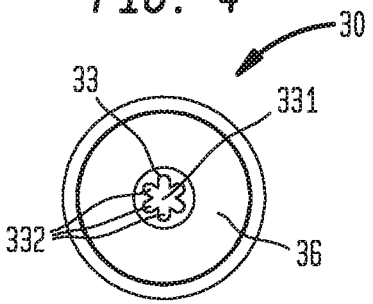
FIG. 4 is a rear view of the nozzle of FIG. 1.
Figure 5:
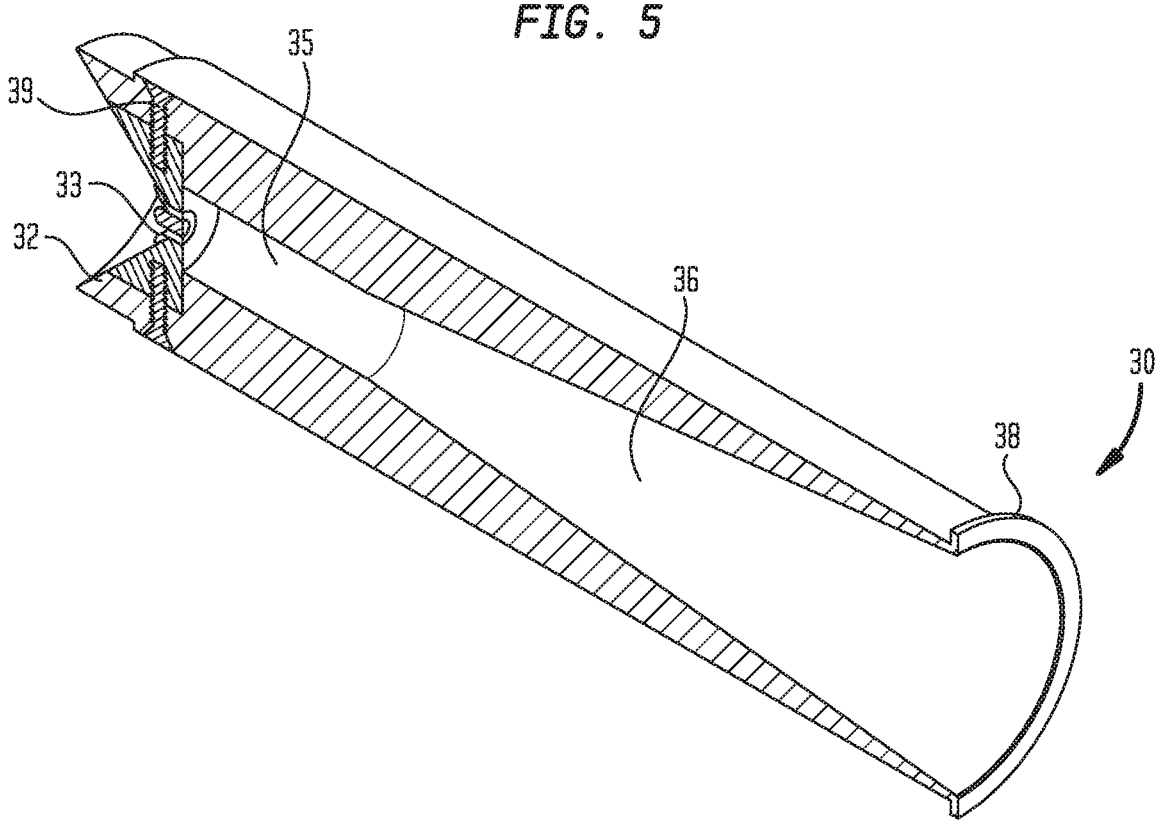
FIG. 5 is a cross-sectional perspective view of the nozzle of FIG. 1.

As may be seen in FIGS. 3 and 4, the orifice 33 may have a star-like shape with a central region 331 and a plurality of angularly spaced-apart, outer regions 332 around the periphery of the central region 331, such as the orifice of the Lobestar Mixing Nozzle®. The outer regions 332 provide, when a liquid flows through the outer regions 332, a vortex flow pattern that provides a shearing effect and thus improved dispersing of the particles in a liquid stream flowing through the nozzle 30. It is contemplated that other shapes may be used for the orifice 33, which in combination with one or more other aspects of the nozzle 30, facilitate a shearing effect and/or vortex generation to induce particle dispersion. In other examples, the orifice 33 may be circular, rectangular, elliptical, or another shape.

The orifice 33 may be formed in an orifice component 34 that is arranged in the nozzle 30. The orifice component 34 is fixed to the first nozzle 30 by a set of fasteners 39, and is removable from the nozzle 30. This allows the orifice component 34 to be replaced by another orifice component, for example, having an orifice 33 of different size or shape. The orifice component 34 may be omitted in the sense that the orifice 33 may be made as an integral part of the first nozzle 30. In one example, the nozzle 30 is made as one integral unit that includes the converging section 32, the orifice 33, the intermediate flow section 35 and the diverging section 36. In one example, the nozzle 30 is made of plastic. Additionally or alternatively, the orifice component 34 may be made from metal. For example, an orifice component 34 having a star-like shape formed therein may be formed from metal.

When a liquid stream flows through nozzle 30 via the nozzle inlet 301, the liquid stream experiences an increased flow velocity as the liquid stream passes through the converging section 32. The liquid stream is subjected to increased shear as the liquid stream passes through the orifice 33 and the intermediate flow section 35 at the increased velocity, thereby facilitating dispersion of particles within the liquid stream. As the liquid stream flows through the diverging section 32, the liquid stream experiences a sudden decrease in flow velocity that creates turbulence which increases the dispersion of particles in the liquid stream. Thus, both the converging section 32 and the diverging section 36 increase the dispersion of particles in the liquid stream.

Figure 6:
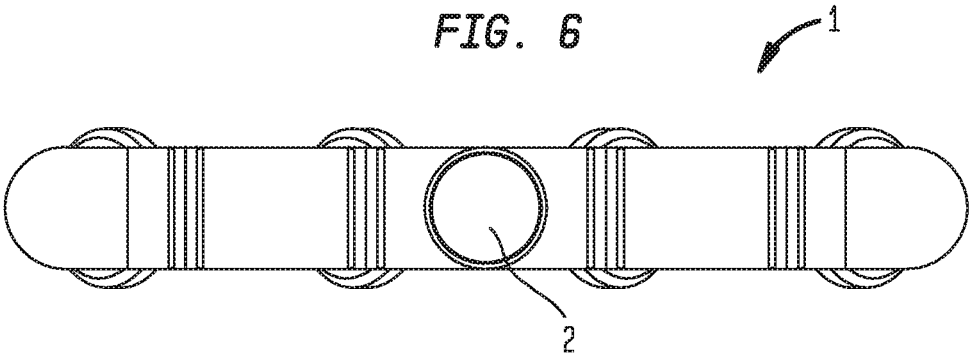
FIG. 6 is a rear view of an apparatus for dispersing particles in a liquid.
Figure 7:
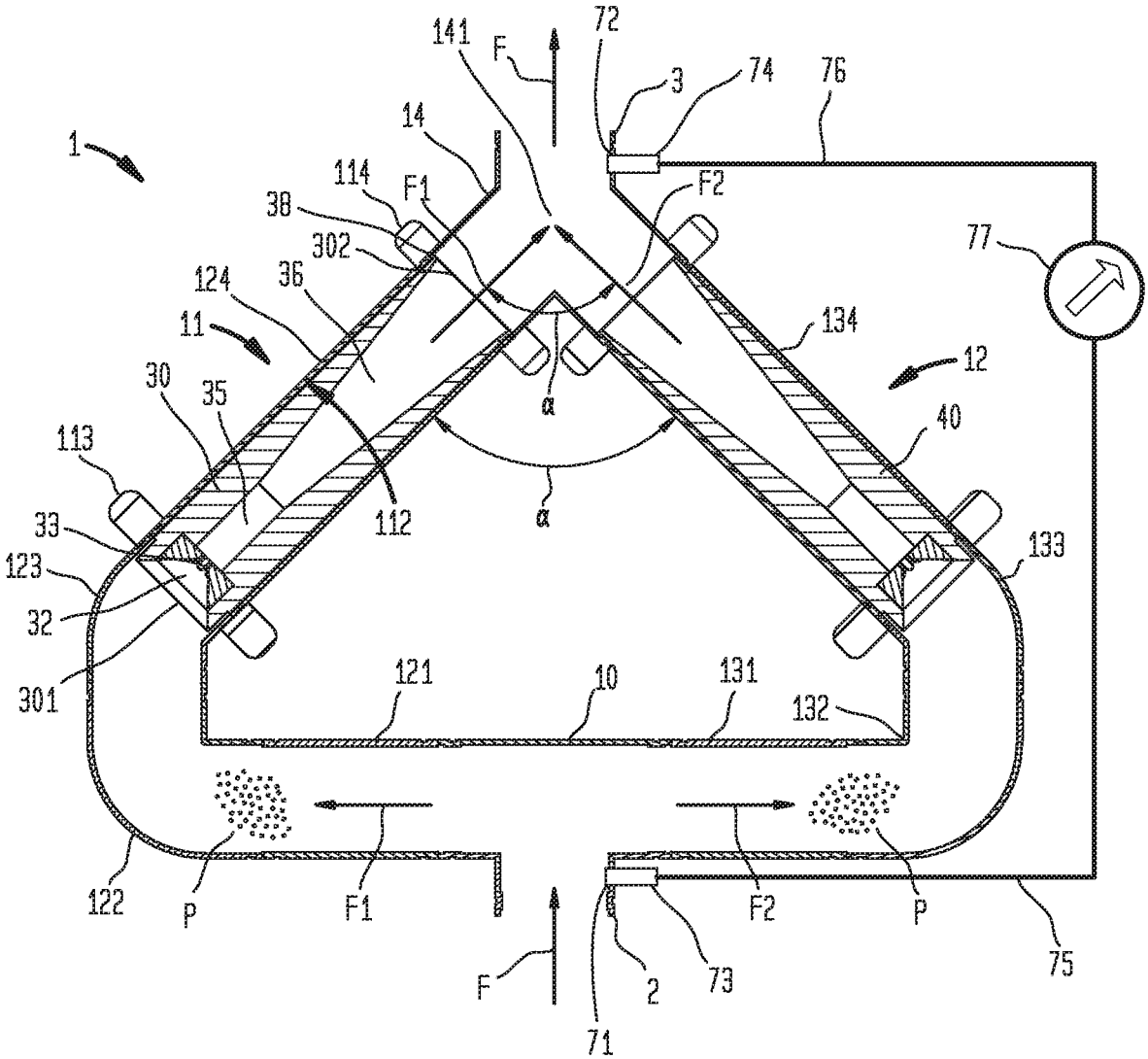
FIG. 7 is a cross-sectional top view of the apparatus of FIG. 6.

FIG. 6 is a rear view of an apparatus 1 for dispersing particles in a liquid. FIG. 7 is a cross-sectional top view of the apparatus of FIG. 6. The apparatus 1 utilizes a plurality of nozzles, described above, to facilitate mixing of particles in a liquid mixture, such as drilling mud.

The apparatus 1 is a flow system that has the principal form of a triangular piping component, with an inlet 2 at a center of the base of the triangle, and with an outlet 3 at the top of the triangle. Liquid F, such as drilling mud, includes particles P when the liquid enters the inlet 2. Once inside the apparatus 1, the particles P are dispersed in the liquid F, as will be described in detail below, before the liquid F leaves the apparatus 1 via the outlet 3. The particles P may to some extent be dispersed in the liquid F when the liquid F enters the apparatus 1, but as a result of flowing through the nozzles 30 within the apparatus 30, the particles within the liquid F become more evenly dispersed, thereby improving the rheology of the liquid F.

In detail, the apparatus 1 comprises a flow divider 10 in form of a T-section pipe where the inlet 2 is the base of the flow divider 10. Alternatively, a Y-section may be used as the flow divider 10. From the inlet 2 the flow divider 10 separates the liquid F into a first liquid stream F1 and a second liquid stream F2. The apparatus 1 has a first liquid branch 11 that is connected to the flow divider 10 for receiving the first liquid stream F1. A second liquid branch 12 is connected to the flow divider 10, on a side that is opposite the side where the first liquid branch 11 is connected. The second liquid branch 12 receives the second liquid stream F2.

The first liquid branch 11 comprises a straight section 121 that is connected to the flow divider 10, a 90° pipe elbow 122 that is connected to the straight section 121, an angled elbow 123 that is connected to the pipe elbow 122, and a second straight section 124 that is connected to the angled elbow 123. The angled elbow 123 is angled by half the angle α.

The second liquid branch 12 comprises a straight section 131 that is connected to the flow divider 10, at an opposite side of the flow divider 10 from where the straight section 121 of the first liquid branch 11 is connected. The second liquid branch 12 is similar to the first liquid branch 11 and has a 90° pipe elbow 132 that is connected to the straight section 131, an angled elbow 133 that is connected to the pipe elbow 132, and a second straight section 134 that is connected to the angled elbow 133. The angled elbow 133 is angled by half the angle α.

The second straight sections 124, 134 of the first liquid branch 11 and the second liquid branch 12 are connected to a branch joining section 14 that receives the first and second liquid streams F1, F2 from the first and second liquid branches 11, 12. The branch joining section 14 has the shape of a y-section pipe. The branch joining section 14 comprises the outlet 3 and the branch joining section 14 has an internal collision zone 141 where the first liquid stream F1 and the second liquid stream F2 meet and collide. When the liquid streams F1, F2 collide they undergo shear since the streams F1, F2 travel with a different velocity relative each other when they meet in the collision zone 141. Generally the velocities of the liquid streams F1, F2 are the same in terms of flow rate, but they have different directions which affects the shear. The collision zone 141 may also be referred to as a shearing zone.

The parts of the two liquid branches 11, 12 are typically made of metal, such as steel, and may be joined to each other by welding. However, the second straight sections 124, 134 of the two liquid branches 11, 12 are typically joined to their respective adjacent parts by two conventional clamps. For example, a first clamp 113 joins a first end of the second straight section 124 of the first liquid branch 11 to the angled elbow 123. A second clamp 114 joins the other end of the second straight section 124 of the first liquid branch 11 to the branch joining section 14. Two similar clamps join the second straight section 134 of the second liquid branch 12 in a similar manner to its adjacent angled elbow 133 and to the branch joining section 14. The clamps may have the form of any conventional clamps that are suitable for joining pipe components, and the sections 123, 124, 14, 134, 133 that are joined by the clamps are fitted with conventional flanges that are compatible with the clamp. By virtue of the clamps, it is possible for an operator to remove the second straight sections 124, 134 of the first and second liquid branches 11, 12.

The first liquid branch 11 and the second liquid branch 12 are arranged at an angle α of 60°-120° relative to one another to direct the first liquid stream F1 and the second liquid stream F2 towards each other at the corresponding angle α of 60°-120°. As a result the first liquid stream F1 and the second liquid stream F2 meet in the collision zone 141 by the same angle α of 60°-120°. The collision angle α between the liquid streams F1, F2 is accomplished by angling each of the angled elbows 123, 133 by half the angle α.

A first nozzle 30 is arranged in the first liquid branch 11 and a second nozzle 40 is arranged in the second liquid branch 12. The second nozzle 40 may incorporate the same features as the first nozzle 30, such that they are similar, or even identical. Thus, every feature that is described for the first nozzle 30 may also be implemented for the second nozzle 40. Each of the nozzles 30, 40 is removable from the liquid branch 11, 12 in which the nozzles 30, 40 are located. Removal of the nozzles 30, 40 is accomplished by releasing respective clamps from the second straight sections 124, 134. The nozzles 30, 40 are located in the second straight sections 124, 134 and by taking a nozzle 30, 40 out from a respective removed straight section, the nozzles 30, 40 may be removed or replaced.

The apparatus 1 has at the inlet 2 a first pressure sensing interface 71 and has at the outlet 3 a second pressure sensing interface 72. The pressure sensing interfaces 71, 72 may be openings to which pressure sensing device 77 is connected. The pressure sensing device 77 is a conventional differential pressure gauge and has a first pressure inlet port 73 and a second pressure inlet port 74 that are attached to the pressure sensing interfaces 71, 72, for example via two pressure conducting lines 75, 76. The differential pressure gauge performs the operation of pressure subtraction through mechanical means, which obviates the need for an operator or control system to determine the difference between the pressures at the pressure sensing interfaces 71, 72. Of course, any other suitable pressure sensing device may be used for determining the differential pressure.

The inclusion of a pressuring sensing device 77 facilitates the determination and monitoring of performance of the apparatus 1, i.e. the capability of the apparatus 1 to effectively disperse particles P in the liquid F. Specifically, the differential pressure across the apparatus 1 is indicative of the extent of shear (and thus particle dispersion) occurring in a liquid as the liquid travels through the apparatus 1, and more specifically, as the liquid travels through one or more nozzles 30. The differential pressure over the apparatus 1 is the difference between the pressure at a position near the inlet 2 and a pressure at a position near the outlet 3. For example, if the pressure at the inlet 2 equals 100 psi and if the pressure at the outlet 3 equals 60 psi, then the differential pressure is 40 psi (100 psi-60 psi).

During operation of the apparatus 1, the differential pressure is monitored and the flow rate of the liquid F is adjusted so as to obtain a predetermined differential pressure that is known to provide proper dispersion of the particles P in the liquid F. Exactly what the predetermined differential pressure should be may depend on a number of factors, such as the size of the apparatus 1, the type of the liquid F and the type of the particles, and is preferably empirically determined by adjusting the flow rate until the particle dispersion is satisfactory. The differential pressure that then can be read is then set as the predetermined differential pressure for the apparatus 1 and for the types of liquid F and particles P that were used.

The pressure sensing device 77 may not necessarily be a differential pressure gauge. The pressure sensing device 77 may also have the form of two conventional pressure meters that are connected to a respective pressure sensing interface 71, 72. These pressure meters then indicate, e.g. to an operator, the differential pressure over the apparatus since the operator may easily determine the differential pressure based on the readings form the pressure meters. It is also possible to indicate the differential pressure to a control system, for example by applying conventional electronic communication techniques. The control system can then adjust, in dependence of the measured pressure readings, i.e. in dependence of the differential pressure Δp, a flow of the liquid F with the particles P that are introduced in the inlet 2 of the apparatus 1.

Figure 8:
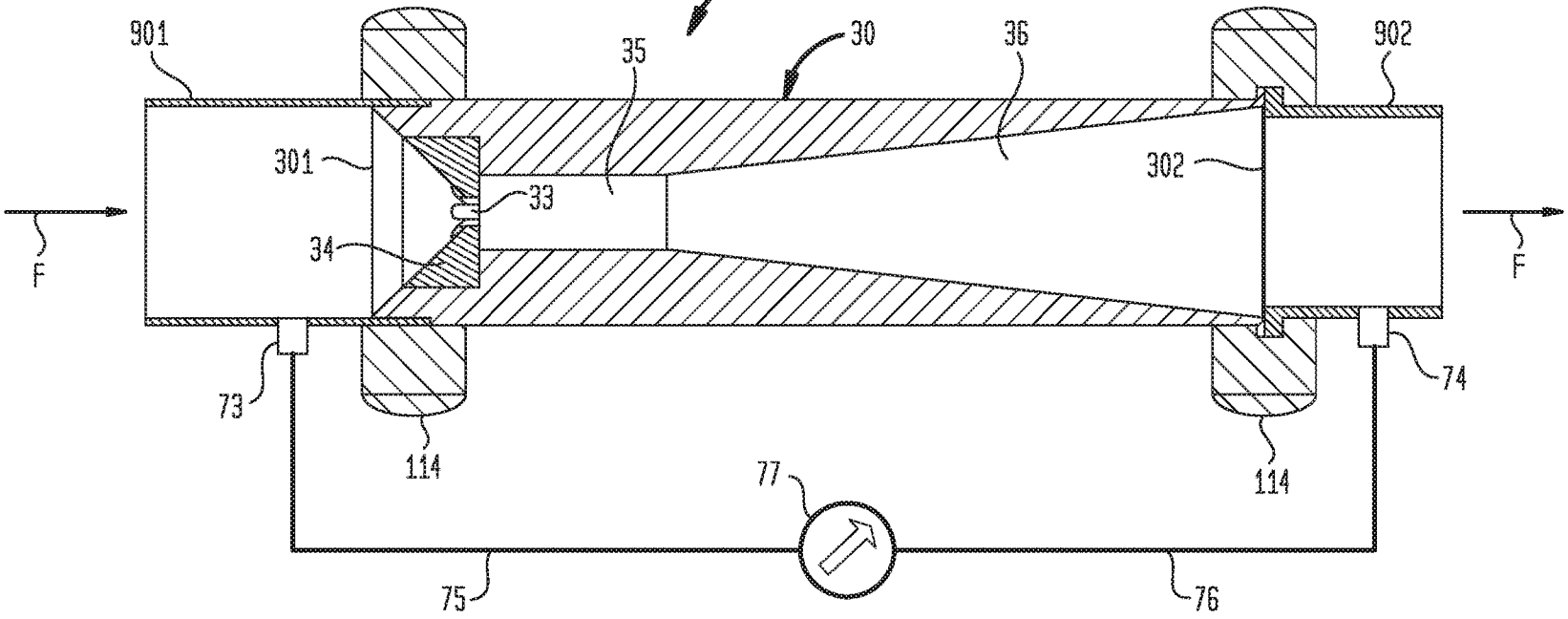
FIG. 8 is a schematic cross-sectional top view of an apparatus for dispersing particles, according to another embodiment of the disclosure.

FIG. 8 is a schematic cross-sectional top view of an apparatus 900 for dispersing particles, according to another embodiment of the disclosure. The apparatus 900 is a flow system that is similar to the apparatus 1, but includes only a single nozzle 30 and is arranged in a linear configuration with respect to incoming and outgoing liquid flow. Due to the linear configuration of the apparatus 900, the apparatus 900 occupies less space than apparatus 1. Thus, the apparatus 900 may be positioned in more space-constrained locations than apparatus 1. Moreover, because only a single nozzle 30 is utilized in the apparatus 900, compared to two nozzles 30 in the apparatus 1, manufacturing costs for apparatus 900 are less than the manufacturing costs of apparatus 1.

The apparatus 900 is coupled to a flow inlet pipe 901 and a flow outlet pipe 902 by clamps 114, and is arranged in a linear configuration with respect to the flow inlet pipe 901 and the flow outlet pipe 902. In one example, it is contemplated that any bends or turns in the flow inlet pipe 901 and the flow outlet pipe 902 are positioned a distance from the nozzle 30 that is four times, and preferably at least six times, the outer diameter of nozzle 30. However, other distances are also contemplated. The use of linear pipe adjacent the nozzle reduces erosion or wear on tees and elbows in the vicinity of the nozzle 30, particularly for components downstream of the nozzle 30. In addition, such lengths of linear pipe also allows turbulence from the nozzle 30 to subside to mitigate damage to pipelines due to excessive vibrations and pressure fluctuations.

The nozzle 30 of the apparatus 900 includes an inlet 301 into which the liquid stream F enters the nozzle 30, and a flow outlet 302 from which the liquid stream F leaves the first nozzle 30. A liquid converging section 32 is positioned downstream of the flow inlet 301 to converge liquid towards the orifice 33. An intermediate flow section 35 is located downstream of the orifice 33, between the orifice 33 and a liquid diverging section 36. The intermediate flow section 35 has a constant diameter. The liquid converging section 32 has a decreasing diameter in a direction towards the orifice 33, and the diverging section 36 has an increasing diameter in a direction towards the flow outlet 302. It is contemplated that the diameters of the orifice 33, the intermediate flow section 35, the converging section 32, and the diverging section 36 may be selected to permit a desired flow rate of liquid therethrough while maintaining a desired pressure drop between the flow inlet 301 and the flow outlet 302. To facilitate determination of the pressure drop, the apparatus 900 may include a pressure sensing device 77, a first pressure inlet port 73, a second pressure inlet port 74, and two pressure conducting lines 75, 76, as similarly described above.

During operation, as the liquid stream F travels through the converging section 32, the velocity of the liquid stream F is increased. The liquid stream F then travels through the orifice 33 and the intermediate flow section 35 at the increased velocity. Subsequently, the liquid stream F travels through the diverging section 36, resulting in a decreased flow rate. The increase in flow rate of the liquid stream F through the orifice 33 and the subsequent decrease in flow rate of the liquid stream F results in a vortex motion of the liquid stream F, as well as turbulence within the liquid stream F. The vortex motion and the turbulence results in mixing of the liquid stream F with the particles therein, thereby resulting in a more homogeneous mixture of particles within the liquid stream F. It is contemplated that a measured pressure drop, as described above, is indicative of velocity changes in the liquid, thereby indicating the extent of mixing in the liquid stream F.

It is contemplated that the apparatus 900 may be retrofitted to existing systems by placing the apparatus 900 inline in a desired piping assembly. For example, the nozzle 30 may be inserted into an existing pipeline via one or more circumferential flanges 38 and/or by mounting the nozzle using a reduced diameter section 190, as shown in FIG. 8. In another example, the nozzle 30 may be inserted into a section of piping, and held in place by a fastener, adhesive, or another manner. In some examples, it is contemplated that a single nozzle 30 is capable of mixing liquids and particles to nearly the same extent as the dual-nozzle configuration illustrated in FIG. 7. In such an example, the orifice 33 of the apparatus 900 is sized to have an area equal to the combined area of the orifices 33 within the nozzles 30, 40 of the apparatus 1, thus providing an equivalent throughput.

Figure 9:
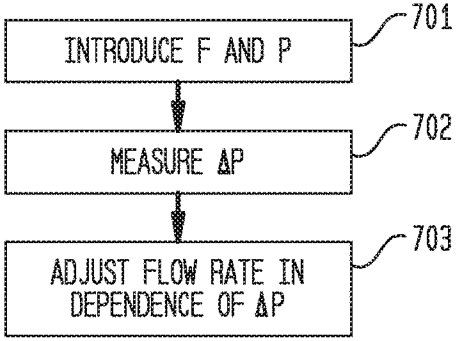
FIG. 9 is a schematic diagram of a method of dispersing particles in a liquid.

With reference to FIG. 9, a method of dispersing the particles P in the liquid F is illustrated. The method may be utilized with any of the above-described apparatuses. The method includes operation 701 in which the liquid F with particles P is introduced into the inlet of an above-described apparatus. Subsequently, in operation 702, a differential pressure Δp is measured as described above. In response to the measured pressure differential, a flow of the liquid F with the particles P is adjusted in operation 703. The adjustment in operation 703 is performed until a predetermined differential pressure Δp is obtained. In detail, the flow, or flow rate, of the liquid F with the particles P therein, may be adjusted in operation 703 by changing a speed of a pump that feeds the mixture of the liquid F and the particles P. A change in the pump speed changes the pressure at inlet of an apparatus, which in turn changes the flow (flow rate) of the liquid F through the apparatus 1. The flow may also be adjusted in operation 703 by throttling a valve that controls the flow of the liquid F having the particles P therein.

Benefits of the disclosed embodiments include improved mixing and dispersion of particles in a liquid mixture. The disclosed nozzle 30, apparatus 1, and apparatus 900 are particularly well-suited towards drilling mud rheology improvement and solids dispersion into a liquid, e.g., solid/liquid mixing. Conventionally, in the drilling industry, the rheology of the drilling mud is the key parameter used to determine quality. At the same time, storage of drilling mud in large tanks for long periods of time is common, which usually results in the deterioration of the rheology because the particle ingredients in the drilling mud—such as barite and bentonite powders, calcium carbonite, or hematite—tend to settle in the tank. However, flow and/or circulation of the drilling mud and particles therein through the disclosed apparatus improves the rheology of the mud without the need to add more powders, thereby reducing costs.

From the description above follows that, although various embodiments of the disclosure have been described and shown, the disclosure is not restricted thereto, but may also be embodied in other ways within the scope of the subject-matter defined in the following claims.

The invention claimed is:

1. A liquid mixture nozzle for flowing a liquid mixture therethrough, comprising:

a body having a flow inlet, a flow outlet, and an axial centerline, the flow inlet configured to couple to a first piece of piping, and the flow outlet configured to couple to a second piece of piping;

a converging section having a decreasing diameter positioned adjacent the flow inlet, the converging section having a narrow end and an axial centerline that is coaxial with the axial centerline of the body, the converging section comprising:

a converging portion of the body comprising a radially inward sidewall disposed at a first acute angle relative to the axial centerline of the body, and a converging portion of an insert comprising a radially inward sidewall disposed at a second acute angle relative to the axial centerline of the body, the second acute angle being the same as the first acute angle;

an orifice formed in the insert and positioned at the narrow end of the converging section, the orifice having an axial centerline that is coaxial with the axial centerline of the body;

an intermediate section having a constant diameter positioned adjacent the orifice, the intermediate section having an axial centerline that is coaxial with the axial centerline of the body, and a cross sectional area that is larger than a cross sectional area of the narrow end of the converging section; and a diverging section having an increasing diameter positioned adjacent the intermediate section and the flow outlet, the diverging section having an axial centerline that is coaxial with the axial centerline of the body, and the intermediate section extending between the orifice and the diverging section along the axial centerline of the body.

2. The liquid mixture nozzle of claim 1, wherein the orifice has a central region and a plurality of angularly-spaced outer regions extending radially from the central region.

3. The liquid mixture nozzle of claim 1, wherein a ratio of cross sectional areas of the intermediate section to the narrow end of the converging section is within a range of 2:1 to 6:1.

4. The liquid mixture nozzle of claim 1, wherein the first acute angle is within a range of about 30 degrees to about 50 degrees.

5. The liquid mixture nozzle of claim 4, wherein a radially inward sidewall of the diverging section is disposed at a third acute angle relative to the axial centerline of the body, and the third acute angle is within a range of about 5 degrees to about 10 degrees.

6. The liquid mixture nozzle of claim 5, wherein a ratio between: (1) the first acute angle of the radially inward sidewall of the converging portion of the body, and (2) the third acute angle of the radially inward sidewall of the diverging section, is about 3:1 to about 10:1.

7. The liquid mixture nozzle of claim 1, wherein a shape of the orifice is selected from the group consisting of elliptical, circular, and rectangular.

8. The liquid mixture nozzle of claim 1, wherein the insert is metallic.

9. The liquid mixture nozzle of claim 1, further comprising a first pressure sensing interface configured to determine a first pressure of the liquid mixture prior to entering the liquid mixture nozzle, and a second pressure sensing interface configured to determine a second pressure of the liquid mixture after exiting the liquid mixture nozzle.

10. The liquid mixture nozzle of claim 1, wherein a first end of the intermediate section is positioned at an end of the insert having the orifice, and a second end of the intermediate section is positioned at an end of the diverging section.

11. The liquid mixture nozzle of claim 1, wherein the radially inward sidewall of the converging portion of the insert is disposed between the intermediate section and the radially inward sidewall of the converging portion of the body along the axial centerline of the body.

12. A flow system, comprising:

a flow inlet pipe;

a flow outlet pipe; and a first liquid mixture nozzle connected to the flow inlet pipe at an upstream end of the first liquid mixture nozzle, and connected to the flow outlet pipe at a downstream end of the first liquid mixture nozzle, the first liquid mixture nozzle comprising:

a body having a flow inlet, a flow outlet, and an axial centerline;

a converging section having a decreasing diameter positioned adjacent the flow inlet, the converging section having a narrow end and an axial centerline that is coaxial with the axial centerline of the body, the converging section comprising:

a converging portion of the body comprising a radially inward sidewall disposed at a first acute angle relative to the axial centerline of the body, and a converging portion of an insert comprising a radially inward sidewall disposed at a second acute angle relative to the axial centerline of the body, the second acute angle being the same as the first acute angle;

an orifice formed in the insert and positioned at the narrow end of the converging section, the orifice having an axial centerline that is coaxial with the axial centerline of the body;

an intermediate section having a constant diameter positioned adjacent the converging section, the intermediate section having an axial centerline that is coaxial with the axial centerline of the body, and a cross sectional area that is larger than a cross sectional area of the narrow end of the converging section; and a diverging section having an increasing diameter positioned adjacent the intermediate section and the flow outlet, the diverging section having an axial centerline that is coaxial with the axial centerline of the body, and the intermediate section extending between the orifice and the diverging section along the axial centerline of the body.

13. The flow system of claim 12, wherein the orifice has a central region and a plurality of angularly-spaced outer regions extending radially from the central region.

14. The flow system of claim 12, wherein the first liquid mixture nozzle further comprises a circumferential flange adjacent the flow outlet.

15. The flow system of claim 12, further comprising a pressure sensing device having a first pressure sensing interface and a second pressure sensing interface, the pressure sensing device configured to determine a first pressure of a liquid mixture prior to entering the first liquid mixture nozzle and a second pressure of the liquid mixture after exiting the first liquid mixture nozzle.

16. The flow system of claim 12, wherein the flow inlet pipe and the flow outlet pipe are linear adjacent the first liquid mixture nozzle for a distance of at least six times an outer diameter of the first liquid mixture nozzle.

17. The flow system of claim 12, wherein a ratio of cross sectional areas of the intermediate section to the narrow end of the converging section is within a range of 2:1 to 6:1.

18. The flow system of claim 12, wherein the first acute angle is within a range of about 30 degrees to about 50 degrees.

19. The flow system of claim 18, wherein a radially inward sidewall of the diverging section is disposed at a third acute angle relative to the axial centerline of the body, and the third acute angle is within a range of about 5 degrees to about 10 degrees.

20. The flow system of claim 19, wherein a ratio between: (1) the first acute angle of the radially inward sidewall of the converging portion of the body, and (2) the third acute angle of the radially inward sidewall of the diverging section, is about 3:1 to about 10:1.

21. The flow system of claim 12, further comprising a second liquid mixture nozzle and a flow divider, wherein the flow divider is configured to divide a liquid mixture entering through the flow inlet pipe into two streams having a first stream diverted through a first branch having the first liquid mixture nozzle and a second stream diverted through a second branch having the second liquid mixture nozzle.

22. The flow system of claim 21, wherein the first branch and the second branch merge into a collision zone downstream of the first liquid mixture nozzle and the second liquid mixture nozzle, and the first branch and the second branch are positioned at an angle of 60 degrees to 120 degrees relative to one another.

23. The flow system of claim 22, further comprising a pressure sensing device having a first pressure sensing interface and a second pressure sensing interface, the pressure sensing device configured to detect a first pressure of the liquid mixture upstream of the flow divider, and a second pressure of the liquid mixture downstream of the collision zone.

24. The flow system of claim 12, wherein a first end of the intermediate section is positioned at an end of the insert having the orifice, and asecond end of the intermediate section is positioned at an end of the diverging section.

25. The flow system of claim 12, wherein the radially inward sidewall of the converging portion of the insert is disposed between the intermediate section and the radially inward sidewall of the converging portion of the body along the axial centerline of the body.

26. A liquid mixture nozzle for flowing a liquid mixture therethrough, comprising:

a body having a single flow inlet, a single flow outlet, and an axial centerline, the single flow inlet configured to couple to a first piece of piping, and the single flow outlet configured to couple to a second piece of piping;

a converging section having a decreasing diameter positioned adjacent the single flow inlet, the converging section having a narrow end and an axial centerline that is coaxial with the axial centerline of the body, the converging section comprising;

a converging portion of the body comprising a radially inward sidewall disposed at a first acute angle relative to the axial centerline of the body, and a converging portion of an insert comprising a radially inward sidewall disposed at a second acute angle relative to the axial centerline of the body, the second acute angle being the same as the first acute angle;

an orifice positioned at the narrow end of the converging section, the orifice having an axial centerline that is coaxial with the axial centerline of the body, the orifice having a central region and a plurality of angularlyspaced-apart outer regions around a periphery of the central region:

an intermediate section having a constant diameter positioned adjacent the orifice, the intermediate section having an axial centerline that is coaxial with the axial centerline of the body, and a cross sectional area that is larger than a cross sectional area of the narrow end of the converging section; and a diverging section having an increasing diameter positioned adjacent the intermediate section and the single flow outlet, the diverging section having an axial centerline that is coaxial with the axial centerline of the body, and the intermediate section extending between the orifice and the diverging section along the axial centerline of the body.

* * * * *